US007748415B2

(12) United States Patent
Barlosov et al.

(10) Patent No.: US 7,748,415 B2
(45) Date of Patent: Jul. 6, 2010

(54) PLASTIC BAND TIGHTENING DEVICE WITH IMPROVED CUTTING MECHANISM

(75) Inventors: Pavlo Barlosov, San Jose, CA (US); Volodymyr Domin, San Jose, CA (US)

(73) Assignee: Teknika, Inc., San Jose, CA (US)

( * ) Notice: Subject to any disclaimer, the term of this patent is extended or adjusted under 35 U.S.C. 154(b) by 340 days.

(21) Appl. No.: 12/004,908

(22) Filed: Dec. 21, 2007

(65) Prior Publication Data

US 2009/0158942 A1 Jun. 25, 2009

(51) Int. Cl.
*B21F 9/00* (2006.01)

(52) U.S. Cl. ..... 140/123.6; 140/152

(58) Field of Classification Search ..... 140/93.2, 140/93.4, 123.5, 123.6, 150, 152; 53/582, 53/592; 100/29, 32, 33 PB
See application file for complete search history.

(56) References Cited

U.S. PATENT DOCUMENTS 2,087,655 A * 7/1937 Prestwich ..... 140/93.2
4,041,993 A * 8/1977 Angarola ..... 140/123.6
5,832,964 A * 11/1998 Joshi ..... 140/123.6
6,047,742 A * 4/2000 Barlasov ..... 140/123.6

* cited by examiner

*Primary Examiner*—Edward Tolan
(74) *Attorney, Agent, or Firm*—Carr & Ferrell LLP

(57) ABSTRACT

A tightening apparatus for strapping an object with a plastic band includes a stationary cutter with a cutting slot, a pivoting cutter mounted inside the stationary cutter, and a resilient element. The resilient element is situated so as to push a cutting edge of the pivoting cutter away from a cutting edge of the stationary cutter when a cutting operation is not being performed. When a band is present between the pivoting and stationary cutters and the cutting operation is actuated, a pivoting force caused by an applied cutting force moves the pivoting cutter against the resilient element and engages the cutting edges of both cutters so as to cut the band. The fact that the cutting edges are engaged only when a band is inserted between the cutters greatly improves the life of the device.

2 Claims, 4 Drawing Sheets

SECTION 6-6. ( FIG. 2)

SECTION 6-6. (FIG. 2)

PLASTIC BAND TIGHTENING DEVICE WITH IMPROVED CUTTING MECHANISM

BACKGROUND OF THE INVENTION

1. Field of the Invention

The present invention relates generally to band tightening devices, and more particularly is a plastic band tightening device with an improved cutting mechanism.

2. Description of the Prior Art

The prior art includes several devices that utilize known methods of cutting a strapping band. Some references representative of the prior art are disclosed in U.S. Pat. No. 4,644,646 to Eli M. Ladin; U.S. Pat. No. 6,047,742 to Barlasov; U.S. Pat. No. 6,962,108 to Hsiu-Man Yu Chen; and U.S. Pat. No. 7,100,499 to Hsiu-Man Yu Chen.

These prior art devices teach a design such as that shown in FIG. 1. The device in FIG. 1 includes a frame 1', a cutting mechanism 2', a tightening mechanism 3', and a band holding mechanism 4'. The cutting mechanism 2' comprises a stationary cutter 21', a pivoting cutter 22' mounted inside the stationary cutter 21', and an actuating lever 23' mounted on the pivoting cutter 22'.

To begin a banding cycle, the operator pushes down on a handle 31', which raises the gripper 41' and allows the user to insert the first end 61' of a band 6' between the gripper 41' and the frame 1'. When the user releases the handle 31', the gripper 41' holds the first end 61' of the band 6' in place.

During the tightening operation, the second end 62' of the band 6' is threaded trough the cutting mechanism 2' and a windlass 32' of a tightening mechanism 3'. The operator applies force to the handle 31' and tightens the band 6'. When sufficient pulling force has been applied, and the two ends 61', 62' of the band are secured with the seal 5', the operator presses the handle 31' down a second time to trigger the actuating lever 23' so that the pivoting cutter 22' cuts the second end 62' of the band 6'.

A significant drawback in the prior art design is that the two cutting edges 21', 22' of the cutting mechanism 2' interact two times during each operational cycle. The first time the two cutting edges 21', 22' contact each other is when the operator pushes the handle 31' down to raise the gripper 41' to load the first end 61' of the band 6'. The second end 62' of the band 6' is not inserted in the cutting mechanism 2' during loading. The second interaction of the two cutting edges 21', 22' is at the end of the operating cycle when the operator pushes the handle 31' down to cut the second end 62' of the band 6' which has been wound around windlass 41' during the tightening operation. The twice per cycle contacts of the stationary cutter 21' and the pivoting cutter 22' greatly accelerates the deterioration of the working edges of the cutter 21', 22'. The edges wear out quickly, and soon do not cut the band 6' efficiently. This is especially true when the device is used on cord straps with a thin fiber structure.

Accordingly, it is a chief object of the present invention to provide a banding device in which the number of contacts of the cutting edges of the cutting mechanism is reduced, thereby significantly increasing the effective working life of the cutting mechanism.

SUMMARY OF THE INVENTION

The present invention is a tightening apparatus for strapping an object with a plastic band. the apparatus comprises a cutting mechanism, a tightening mechanism, and a band holding mechanism. The cutting mechanism, which is the subject of the present invention, comprises a stationary cutter with a cutting slot, a pivoting cutter mounted inside the stationary cutter, and a resilient element. The resilient element is situated so as to push a cutting edge of the pivoting cutter away from a cutting edge of the stationary cutter when a cutting operation is not being performed. When a band is present between the pivoting and stationary cutters and the cutting operation is actuated, a pivoting force caused by an applied cutting force moves the pivoting cutter against the resilient element and engages the cutting edges of both cutters so as to cut the band. The fact that the cutting edges are engaged only when a band is inserted between the cutters greatly improves the life of the device.

An advantage of the present invention is that the cutting edges of the cutting mechanism contact each other only once per operating cycle, as opposed to the two contacts required in prior art devices.

Another advantage of the present invention is that the useful life of the cutting mechanism is at least doubled.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
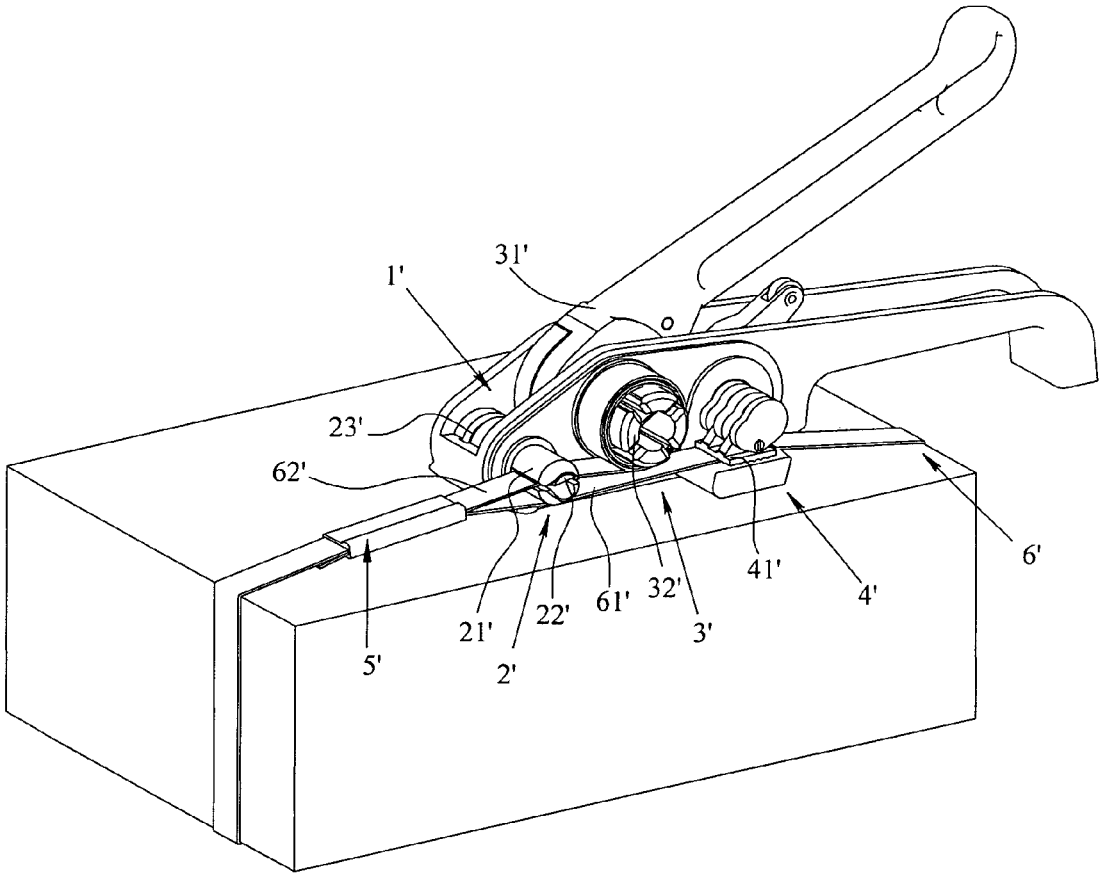
Fig. 1 PRIOR ART
FIG. 1 is a perspective view of a conventional band tightening device.
Figure 2:
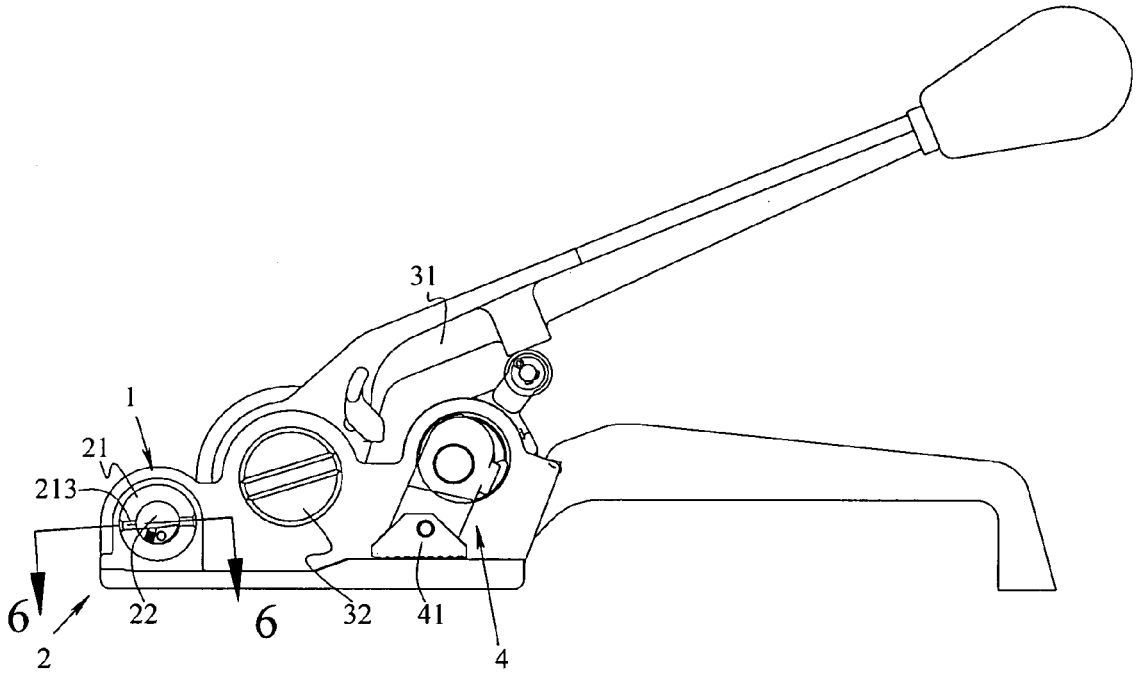
FIG. 2 is a left side view of the tightening device of the present invention showing the cutting mechanism with the tension handle in the initial position.
Figure 3:
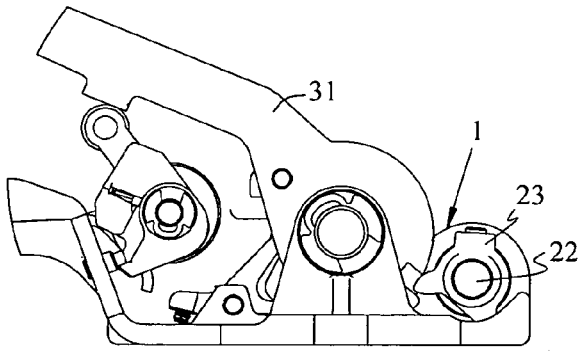
FIG. 3 is a right side view of the tightening device showing the back side of the cutting mechanism with the tension handle in the initial position.

The present invention is a plastic band tightening apparatus as shown in FIGS. 2-7. The band tightening apparatus comprises a frame 1 on which are mounted a cutting mechanism 2, a tightening mechanism 3, and a band holding mechanism 4. The tightening mechanism 3 and the band holding mechanism 4 (which secures a band 6 in place during the tightening operation and is situated near a rear end of the tool) are known in the prior art and are thus not described in great detail herein.

A key feature of the present invention is the cutting mechanism 2 that cuts the plastic band 6 after the band 6 is tightened by the tightening mechanism 3. The cutting mechanism 2 (see FIGS. 2, 6*a-c*, and 7*a-c*) comprises a stationary cutter 21, a pivoting cutter 22 pivotally mounted inside the stationary cutter 21, an actuating lever 23 mounted on the pivoting cutter 22, and a blade 27 pivotally mounted on the pivoting cutter 22 by means of a pin 26.

Only a very small section of the length of a cylindrically-shaped portion 222 of the pivoting cutter 22 has a diameter equal to the diameter of an inner surface 212 of the stationary cutter 21. This allows the pivoting cutter 22 to move from side to side about a pivot point (the point where the diameter of the cylindrical portion 222 of the pivoting cutter 22 is equal to the diameter of the inner surface 212 of the stationary cutter 21) within the stationary cutter 21.

The first portion of a resilient element 24 is secured in a recess in the stationary cutter 21 so that it contacts the first end 221 of the pivoting cutter 22. A pushing force G1 of the first portion of a resilient element 24 urges the first end 221 of the pivoting cutter 22 toward the side wall of the stationary cutter 21 that includes a cutting edge 211, thereby moving a second end of the pivoting cutter 22, which comprises a top cutting edge 271 of the blade 27, away from a cutting edge 211 of the stationary cutter 21. The pushing force of the first portion of a resilient element 24 counterbalances an opposing force, component P of a cutting force Q (Refer to FIGS. 5 and 7*a*).

Figure 6A:
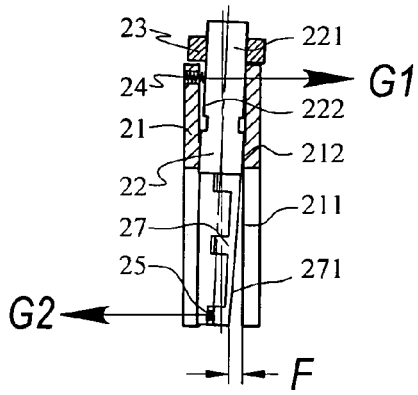
FIG. 6*a* is a sectional view taken along line 6-6 in FIG. 2 showing the cutting mechanism in the initial position with no band inserted.
Figure 7A:
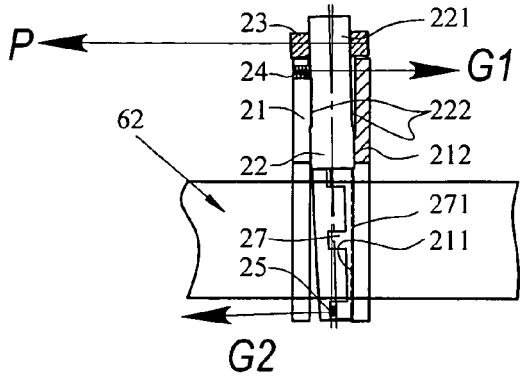
FIG. 7*a* is a cutaway view of the cutting mechanism when it is activated for cutting an inserted band.

When the cutting mechanism 2 is in an initial position, the pivoting cutter 22 is in the position shown in FIG. 6*a*, with a clearance F between the cutting edge 271 of the blade 27 and the inner surface 212 of the stationary cutter 21.

Figure 6B:
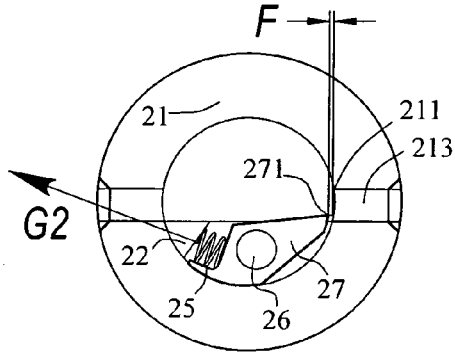
FIG. 6*b* is an end sectional view of the cutting mechanism in the initial position with no band inserted.

The second portion of the resilient element 25 is mounted on the pivoting cutter 22 in such a way that resilient force G2 pushes the cutting edge 271 of the blade 27 away from the inner surface 212 of the stationary cutter 21 and thereby maintains a clearance F (FIG. 6*b*).

Figure 4:
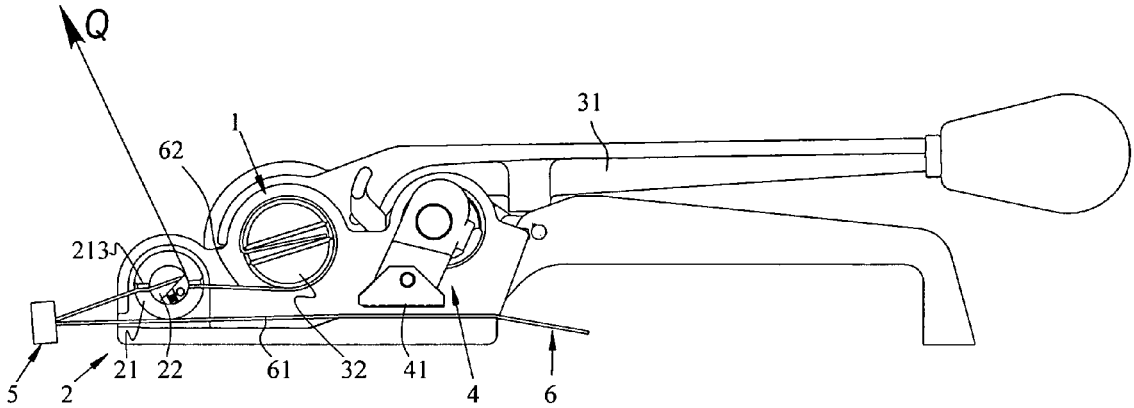
FIG. 4 is a left side view of the tightening device showing the tension handle in the cutting position.
Figure 5:
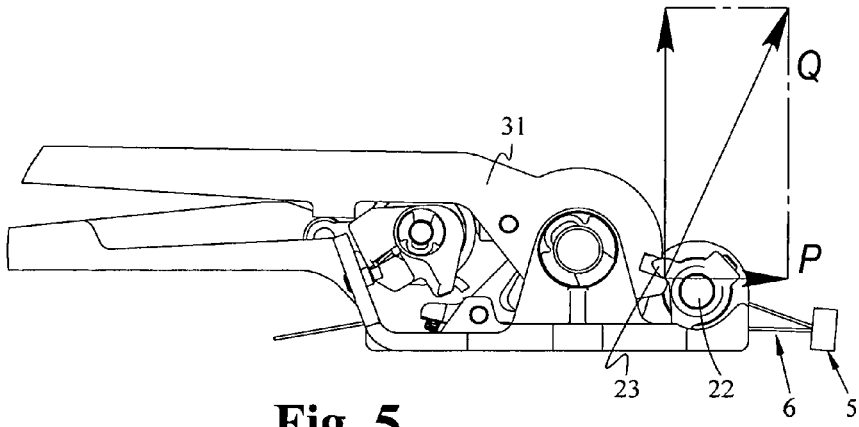
FIG. 5 is a right side view of the tightening device showing the back side of the cutting mechanism with the tension handle in the cutting position.

The cutting mechanism 2 and the band holding mechanism 4 are both actuated by an operator pressing down on a handle 31 of the apparatus as illustrated in FIGS. 4 and 5. When the handle 31 is depressed, a gripper 41 is raised away from a flat portion of the frame 1. With the band tightening apparatus in this position, it is easy to load the first end of the band 61 between the gripper 41 and the flat portion of the frame 1. The downward motion of the handle 31 also moves the actuating lever 23 which operates the pivoting cutter 22.

Figure 6C:
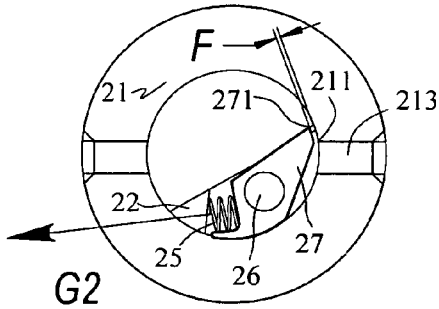
FIG. 6*c* is an end sectional view of the cutting mechanism when it is actuated to load the band.
Figure 7C:
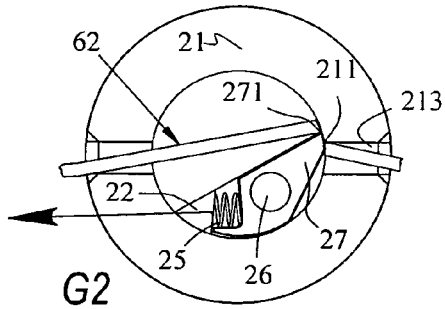
FIG. 7*c* is an end sectional view of the cutting mechanism at the end of the cutting operation.

During the band loading operation, resilient forces G1 and G2 created by resilient elements 24 and 25 push the pivoting cutter 22 to the position shown in FIGS. 6*a-c*. In this position, there is no contact (note clearance F) between the cutting edge 271 of the blade 27 and the cutting edge 211 of the stationary cutter 21. After the operator loads the first end 61 of the band 6 and releases the handle 31, the gripper 41 returns to the position shown in FIG. 2, and securely holds the first end 61 of the band 6.

During the tightening operation, the second end 62 of the band goes around the article(s) to be secured, and is fed through a slot 213 of the stationary cutter 21. The second end 62 of the band 6 is then secured in a windlass 32 of the tightening mechanism 3. (See FIG. 4.) The operator tightens the band 6 around the article(s) by moving the ratchet handle 31 back and forth to rotate the windlass 32. As the windlass 32 is rotated, the band 6 tightens around the article(s) to be secured.

When the band 6 is sufficiently tightened and both ends of the band 6 are secured together by securing means 5, the operator again pushes the handle 31 downward to the cutting position (FIGS. 4 and 5). The downward motion of the handle triggers two mechanisms: First, the gripper 41 of the band holding mechanism 4 is raised again so that the first end 61 of the band 6 is released. Second, the cutting mechanism 2 is actuated. As the handle 31 moves downward, it contacts the actuating lever 23 which rotates the pivoting cutter 22 to the cutting position shown in FIG. 7*a*.

Figure 7B:
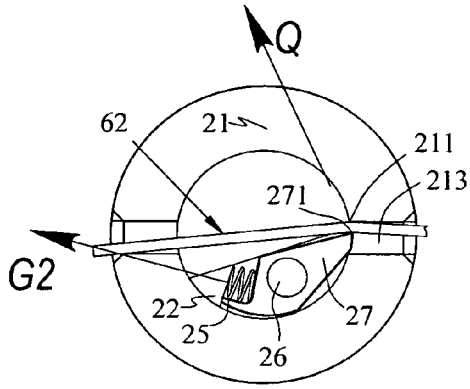
FIG. 7*b* is an end sectional view of the cutting mechanism at the beginning of the cutting operation.

When the cutting mechanism 2 is actuated with a second end 62 of the band 6 present, a cutting force Q is generated (see FIGS. 4, 5, 7*b*, and 7*c*). The cutting force Q from the band 6 causes the blade 27 to rotate around pin 26. As illustrated in FIG. 7*b*, this eliminates clearance F, so that the cutting edge 271 of blade 27 is in position to engage the cutting edge 211 of the stationary cutter 21.

A force component P of the cutting force Q is greater then the force G1 of the first portion of a resilient element 24, and cutting force Q is greater then the force G2 of the second portion of the resilient element 25. Therefore cutting force Q pushes the pivoting cutter 22 to the position shown in FIGS. 7*a* and 7*b*. Because of the now modified (due to the presence of the second end 62 of the band 6) position of the blade 27, as the pivoting cutter 21 rotates, the cutting edge 271 of the blade 27 engages the cutting edge 211 of the stationary cutter 21, thereby causing the second end 62 of the band 6 to be cut.

The presence of the resilient elements 24 and 25 creates a clearance F in the cutting mechanism 2 when the second end 62 of a band 6 is not present, i.e. during loading. Therefore the cutting edge 211 of the stationary cutter 21 and the cutting edge 271 of the blade 27 are engaged only once during each operating cycle, during the cutting operation. This is true even though the operator, by depressing handle 31 during loading and cutting, initiates the pivoting cutter 22 two times per operating cycle. The reduced contact of the two cutting edges 271 and 211 during the loading phase of the operating cycle lengthens the useful working life of the cutting mechanism 2 to at least double that of prior art mechanisms. This is particularly important when the apparatus is used for cutting cord strapping bands that comprise fine fiber threads, which requires the cutting edge 211 of the stationary cutter 21 and the cutting edge 271 of the blade 27 to be in precise contact.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

We claim:

1. An apparatus to tighten plastic bands comprising:

a cutting mechanism, a tightening mechanism, and a band holding mechanism; wherein said cutting mechanism comprises a stationary cutter, a pivoting cutter pivotally mounted inside said stationary cutter, an actuating lever that operates said pivoting cutter, a blade pivotally mounted on said pivoting cutter, and a resilient means; wherein said resilient means creates a resilient force that urges said pivoting cutter away from said stationary cutter during a band loading operation when said actuating lever is operated, such that a clearance is created between a cutting edge of said pivoting cutter and a cutting edge of said stationary cutter so that said pivoting cutter and said stationary cutter do not contact each other during the band loading operation, and wherein when said actuating lever is operated during a band cutting operation with a tightened band present, said resilient force is overcome, thereby eliminating said clearance between said cutting edge of said pivoting cutter and said cutting edge of said stationary cutter so that the band is cut.

2. The plastic band tightening apparatus of claim 1 wherein:

said pivoting cutter pivots within said stationary cutter about a section of said pivoting cutter whose diameter is equal to that of an interior of said stationary cutter.

* * * * *

UNITED STATES PATENT AND TRADEMARK OFFICE

CERTIFICATE OF CORRECTION

PATENT NO. : 7,748,415 B2
APPLICATION NO. : 12/004908
DATED : July 6, 2010
INVENTOR(S) : Pavlo Barlasov et al.

It is certified that error appears in the above-identified patent and that said Letters Patent is hereby corrected as shown below:

On the cover page, items (12) and (75), the inventor's name is Barlasov.

Signed and Sealed this

Ninth Day of November, 2010

David J. Kappos

David J. Kappos
*Director of the United States Patent and Trademark Office*